US007715582B2

(12) United States Patent
Ochsenbein

(10) Patent No.: US 7,715,582 B2
(45) Date of Patent: May 11, 2010

(54) HEARING DEVICE WITH LOCKING SYSTEM FOR CONNECTORS

(75) Inventor: André Lucien Ochsenbein, Wolfhausen (CH)

(73) Assignee: Phonak AG, Stafa (CH)

( * ) Notice: Subject to any disclaimer, the term of this patent is extended or adjusted under 35 U.S.C. 154(b) by 1101 days.

(21) Appl. No.: 11/348,078

(22) Filed: Feb. 6, 2006

(65) Prior Publication Data

US 2007/0183611 A1 Aug. 9, 2007

(51) Int. Cl.
*H04R 25/00* (2006.01)

(52) U.S. Cl. ..... 381/330; 381/322; 381/324; 381/328

(58) Field of Classification Search ..... 381/322, 381/324, 327–328, 330, 381–382
See application file for complete search history.

(56) References Cited

U.S. PATENT DOCUMENTS

| | | | | |
|---|---|---|---|---|
| 3,197,576 | A | 7/1965 | Martin | |
| 6,009,183 | A * | 12/1999 | Taenzer et al. | 381/330 |
| 7,027,608 | B2 * | 4/2006 | Fretz et al. | 381/330 |
| 7,110,562 | B1 * | 9/2006 | Feeley et al. | 381/322 |
| 7,522,743 | B2 * | 4/2009 | Dobras et al. | 381/381 |

FOREIGN PATENT DOCUMENTS

| | | | |
|---|---|---|---|
| EP | 1681904 | A1 | 7/2006 |
| WO | 2004/025990 | A1 | 3/2004 |

OTHER PUBLICATIONS

European Search Report, EP06101323, Jul. 24, 2006.

* cited by examiner

*Primary Examiner*—Suhan Ni
(74) *Attorney, Agent, or Firm*—Pearne & Gordon LLP

(57) ABSTRACT

The present invention provides a hearing device with locking apparatus comprising a first component (10) with a housing (11) being adapted to be carried outside of or at the human body, a second component (20) to be inserted either partially or fully into an ear canal of a human body and connecting means connecting mechanically said first and said second component (10;20). The connecting means comprise a tube (30) and a first fastener (31) being arranged at one end of said tube (30) and being adapted to detachably connect said second component (20) with said connecting means. The first fastener (31) further comprises an individual locking element (5;9) to be swiveled into retaining or locking surfaces (24') arranged within said second component (20), thereby contacting outer surfaces of said first fastener (31) in its connected state with said second component (20). The first fastener (31) thus will be detachably secured to the second component (20) of the hearing device.

20 Claims, 4 Drawing Sheets

HEARING DEVICE WITH LOCKING SYSTEM FOR CONNECTORS

TECHNICAL FIELD

This invention relates generally to hearing devices, hearing instruments or hearing aids and particularly to hearing devices with at least a first component to be arranged outside the ear or the ear canal respectively and a second component to be arranged in the ear or ear canal respectively, communicatively connected to each other by connecting means.

BACKGROUND OF THE INVENTION

State of the art hearing devices are commonly either behind-the-ear (BTE) hearing devices, in-the-ear (ITE) hearing devices, in-the-canal (ITC) hearing devices or completely-in-the-canal (CIC) hearing devices. BTE hearing devices comprise sound conduction tubes to transmit the amplified sound from the BTE hearing device arranged behind the ear into the user's ear canal. The other hearing devices, ITE, ITC and CIC, are already arranged at or in the ear canal and thus have only short sound conduction tubes or no tubes at all.

Although the ITC and especially CIC hearing devices are preferred by many users due to their low visibility from outside, their drawbacks of limited maximum amplification, limited battery lifetime, limited receiver quality and not suitable space within the ear canal, BTE hearing devices are still demanded and will still be used in the future.

In order to combine the advantages of BTE hearing devices and ITE, ITC and CIC hearing devices, combined hearing devices have already been proposed, comprising essentially two separate parts. The first part comprises most of the electronic modules, such as micro processors, tuners, power source, regularly in form of replaceable or re-chargeable batteries, and microphones and is adapted to be worn externally by the user, either behind the ear or to be clipped to the clothing of the user. This part will be called the BTE part. The second part comprises an output transducer, regularly a speaker, and a shell, which is adapted or shaped to be worn partially or completely within the ear canal. This part will be called ITC or CIC part respectively. Those two parts are usually connected to each other by a permanently wired connection.

In the field of hearing aids, the electric-to-acoustic transducer, regularly a speaker, is called receiver, as it will be done further on in this description.

A modular connector system for auditory devices of the type of combined BTE/CIC is known from WO2004/025990. The BTE-component of this earpiece auditory device is connected via a connector to the CIC-component comprising the receiver.

The connector consists of a hollow tube with electric wires within this tube. The connector is either hard wire coupled or detachably coupled to the receiver and thus to the CIC-component. The receiver is coupled to the shell of the CIC-component either by mean of a fastener or directly plugged into an opening of the shell. The shell may include an ear mold to be inserted into the ear canal of the user.

The fastener is either fixed to the shell by resilient snap-in tongues or by means of screws. The use of the resilient snap-in tongues allows an easy assembling of the fastener, but is only suitable if the shell of the CIC-component includes a soft ear mold, that may be squeezed to loosen the tongues for a non-destructively disassembling of the fastener and therefore of the connector. Such a fastening means is not suitable in case of rigid shells, as the fasteners may not be disassembled without breaking at least a part of the shell or the fastening means. In any case, this can only be done by specialists skilled in the art.

The use of detachable connecting means such as screws on the other hand requires a well-skilled and time-consuming assembling technique and further disturbs the regularly smooth shape of the outer surface of the housing of the CIC-component. Furthermore, the screws require a certain amount of space in their axial direction which is opponent to the requirement of miniaturization and reduces the freedom of design of the shape of the housing of the CIC-component. Thus, only a limited miniaturization is possible and not all possible ear canal geometries may be covered by such a construction.

SUMMARY OF THE INVENTION

It is an object of the present invention to provide an improved detachable connection between the two components of such a hearing device and the connection means.

The present invention provides a hearing device with locking apparatus comprising a first component with a housing being adapted to be carried outside of or at the human body; a second component to be inserted either partially or fully into an ear canal of a human body; a connecting means connecting mechanically said first and said second component, comprising a tube and a first fasteners being arranged at one end of said tube; said first fastener, being adapted to detachably connect said second component with said connecting means; further comprising an individual locking element to be swiveled into retaining or locking surfaces arranged within said second component, thereby contacting outer surfaces of said first fastener in its connected state with said second component.

To prevent the first fastener to be pulled out of said second component, a swiveling individual locking element is provided to securely lock said first fastener within said second component. By providing said locking element at the second component, the first fastener arranged at one end of the connecting means may be easily fixed and on demand later on detached from said second component of the hearing device. Thus, an easy disconnection of the second component from the connecting means and therefore from the first component of the hearing device may be performed and a quick and easy replacement of the first component or eventually of the second component may be accomplished.

In a further embodiment, an opening is arranged at the second component for receiving at least a part of said first fastener, wherein at least one recess is arranged at the sidewall of said opening providing said retaining or locking surfaces for said individual locking element. The recess will receive the respective ends of the locking element, when the locking element is turned or swiveled into its locking position. Therefore, the recess is arranged at the sidewall of said opening, within the turning or swiveling plane of said locking element. Preferably, the width of such a recess is slightly lower than the thickness of the end parts of the respective locking element to be inserted into such a recess. The locking element will thereby be resiliently jammed in its locking position. An unintentional loosening of the locking element will thus be prevented.

In a further embodiment, two recesses are arranged at opposite sidewalls of said opening. Thus by turning or swiveling said locking element into the locking position, the two opposing locking parts or edges of the locking element will be inserted together into the recesses, thereby assuring the locking plate to keep its alignment within its turning or swiveling plane.

In a further embodiment, said locking element is a thin locking plate, to be arranged transversally to the insertion direction of the first fastener into said second component. A great advantage of having such a locking element is the fact, that due to its small thickness, the additional space needed in the insertion direction is only marginal and does practically not affect the overall length of said first fastener with receiver.

In a further embodiment, the locking plate has a rhombic shape, preferably with rounded edges at least at the smaller diameter of said plate, and has an opening arranged in its center. Said opening may be rectangular, triangular, square, hexagonal or of any other shape suitable for turning said locking plate with a corresponding shaped tool.

A first advantage of this shape of the locking plate is its easy but defined insertion position into the opening for the first fastener in the second component. As this opening will regularly have a rectangular shape, the locking plate may only be inserted in its unlocking alignment. The rounded edges will then allow a smooth turning of the locking element about around 45° in its locking position. The turning of the locking element may be performed by inserting the end of a screw driver into said rectangular opening. Thus, the locking and unlocking of the locking element may be quickly and easily done without the need of having skilled knowledge.

In a further embodiment, the hearing device further comprises a second fastener being arranged at the other end of said tube and adapted to detachably connect said first component with said connecting means. Thus, the connecting means may not only be detached from said second component of the hearing device, but as well from the first component of the hearing device. That may be very useful if the connecting means only has to be replaced.

In a further embodiment, said tube of the connecting means is a hollow tube with at least one end-to-end opened channel arranged within said tube. This channel may be used to keep the electric wires for the receiver or for the transmission of sound from an external source to the second component of the hearing aid. It is clear, that not only one channel may be arranged within said channel, but two or more channels may be arranged within said channel.

In a further embodiment, a solid wire is provided within said tube, said solid wire being firmly attached to either one or both fasteners. Such a solid wire may act as a pull-out safety device preventing the tube from being pulled out from its fastener.

In an alternative embodiment, said second component is an ITE-device having a faceplate and a shell connected to said faceplate.

In a further embodiment, an opening is provided in said faceplate for entering said first fastener into said shell of said ITE-device. The shape of this opening corresponds to the cross section of the fastener.

In a further embodiment, a cavity is provided at said faceplate arranged at the inside of said shell, either made as a part of said faceplate or as a separate part attached to said faceplate. The opening of the faceplate thus leads directly into said cavity. The cavity may be made by directly forming the inside of the faceplate respectively. Preferably, the shape of the cavity corresponds to the outer shape of the first fastener. Thus, the fully inserted first fastener will be firmly embedded by the walls of said cavity. Alternatively, it is possible to build said cavity by providing a separate shell, for instance made out of another material than the faceplate. Preferably, the material of the housing of said cavity is a soft and adaptable plastic material to elastically embedding said first fastener in its inserted state. This cavity has at its bottom end an opening or an open channel, acting as sound transmitting channel from the front end of a receiver arranged at the end of the fastener to the inside of the ear opposite to the eardrum.

In a further embodiment, said first fastener comprises a multipart housing, comprising at least two half-shells attached to each other. The first fastener may be composed out of two half-shells that may be attached to each other to form the final housing of the first fastener.

In an alternative embodiment, the locking element is a pin, for instance with truncated conically shaped ends. It has been found, that the use of a pin, preferably with a small diameter, is as well usable for locking the first fastener within the second component of the hearing device. Furthermore, the pin in its locking position, lying crosswise within the opening of the second component, may be used as holding bar for any device or element to be attached to this bar. Thus, an element with ears formed by two resiliently arranged grippers, may be detachable clamped to the bar by sliding the ears over the bar.

In a further embodiment, a recess is provided at the back end of said first fastener to receive said locking element, having a shape that allows the locking element to be turned or swiveled around an axis perpendicular in relation to the surface of the back end of said first fastener. The locking element thus will on one hand be defined when positioned at the back end of said first fastener and on the other hand be defined when rotated from the unlocked into the locked position.

In a further embodiment, the hearing device further comprises a covering plate covering the back end of said first fastener in its inserted state within said second component. The covering plate will close the opening provided for the first fastener and thereby provide a smooth and regular outer surface of the second component of the hearing device. This covering plate further prevents the inside of said opening of being contaminated by wear and dust.

In a further embodiment, said hearing device has tongues arranged at the inner side of the covering plate to resiliently be plugged into respective receiving bores arranged at the back end of said first fastener. To hold the covering plate in its covering position, the tongues are plugged into the bores by pressing onto the outside surface of the covering plate.

DESCRIPTION OF THE DRAWINGS

For purpose of facilitating and understanding of the invention, some exemplary embodiments are illustrated in the accompanying drawings to be considered in connection with the following description. Thus the invention may be readily understood and appreciated, but not limited to these embodiments.

DESCRIPTION OF A PREFERRED EMBODIMENT

Figure 1:
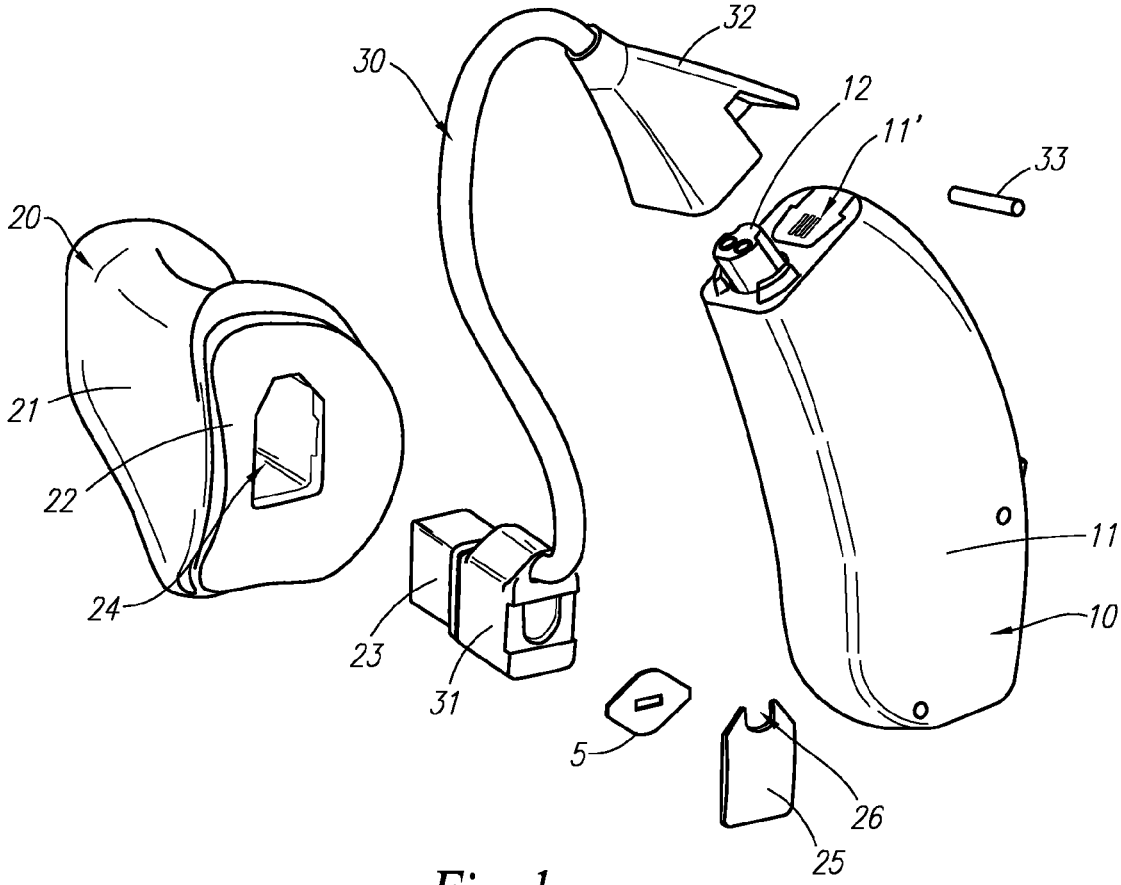
FIG. 1 is an exploded isometric view of an embodiment of a hearing device with locking element according to the present invention.

Referring to FIG. 1, a first embodiment of a hearing device according to the present invention is shown in its partly disassembled state. The hearing device comprises a BTE-device 10 (behind-the-ear) as a first component, an ITE-device 20 (in-the-ear) as a second component and a tube 30 as connecting means between the BTE-device and the ITE-device.

The BTE-device 10 has a housing 11 adapted to be worn behind the ear by the user and containing common electronic modules, such as a sound processing circuitry, microphone and battery.

The ITE-device 20 has a housing 21 adapted to be inserted into the outer part of the ear canal. The shape of housing 21 in this example is individually shaped to fit exactly into the ear shell and/or ear canal of an individual person. This is done by applying an individual fitting process by a specialized fitter. A faceplate 22 is arranged at the back end of housing 21, to receive the active components of ITE-device 20 as well as tube 30.

Tube 30 has a first fastener 31 arranged at its left end and a second fastener 32 arranged at its right end. The second fastener 32 is adapted in its shape and functionality to be plugged onto the upper front 11' of housing 11 of BTE-device 10. The second fastener 32 will be secured to the housing 11 by a pin 33 which may be inserted through bores arranged transversally to the connecting direction in both the second fastener 32 and the connecting part 12 of housing 11.

The connecting part 12 comprises two electrical female connectors to be connected to electric cables arranged within tube 30 or its male connectors of first fastener 32.

The first fastener 31 is put over the back end of a receiver 23 of the ITE-device 20. The first fastener 31 together with the receiver 23 may be inserted into the inside of housing 21 of the ITE-device 20 through an opening 24 arranged in faceplate 22. A locking plate 5 is inventively provided to firmly hold first fastener 31 in its inserted position within ITE-device 20 or faceplate 22 respectively. The function of locking plate 5 will be described more precisely later in this description.

To cover and seal opening 24 of faceplate 22, a covering plate 25 is provided to be inserted over opening 24, having an aperture 26 for the lead through of tube 30.

Figure 2:
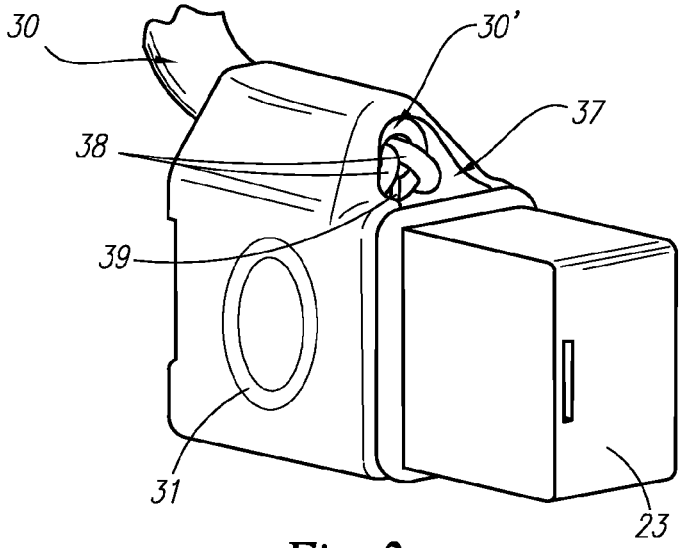
FIG. 2 is a front view onto the right-side of a fastener with inserted receiver of the embodiment of FIG. 1.

For a communicative connection between the BTE-device 10 and the ITE-device 20, two electric wires 38 are arranged within tube 30 for establishing an electrical connection between receiver 23 and electronic components of the BTE-device 10, as depicted in FIG. 2. The ends of the electric wires 38 are bent around the end 30' of tube 30 and led to the interior back side of first fastener 31 to electric contacts arranged at the backside of receiver 23. The electric wires 38 may be soldered to those electric contacts or electrically connected in any other known manner.

The position of the end 30' of tube 30 may be secured by pressing, gluing or any other suitable connecting means within the bore or opening 37 of the housing of the first fastener 31. The end of an additional, solid wire 39, acting as a pull-out safety device, is additionally secured to the housing of first fastener 31, preferably within or close to the bore or opening 37.

This solid wire 39 runs for example together with the wires 38 within tube 30 from the first fastener 31 to the second fastener 32. Both types of wire 38 and 39 are preferably arranged within the hollow space of tube 30, but may be as well arranged within the wall of tube 30. Tube 30 may have a single open channel or multiple open channels.

Figure 3:
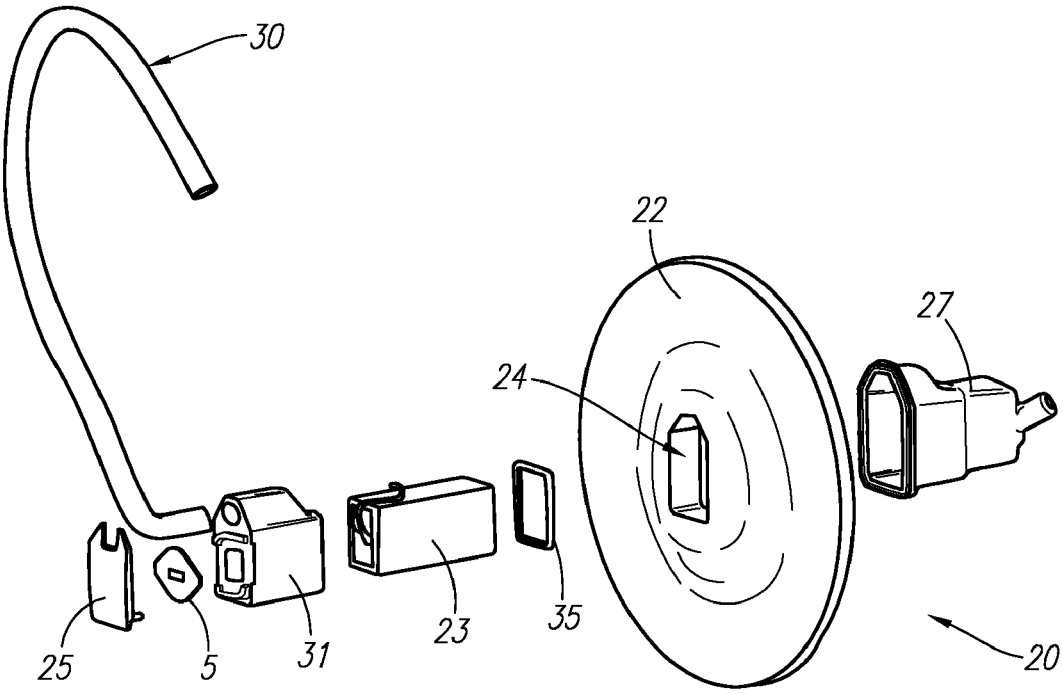
FIG. 3 is an exploded isometric view onto a further embodiment of an ITE-part of a hearing device according to the present invention.

In FIG. 3, the view of a disassembled embodiment of a first fastener 31 and ITE-device 20 according to the present invention is shown. The cavity 27 is made as a hollow part separate from faceplate 22 and not as a one piece part. This part may for example be made out of plastic, for instance as a rigid or elastic mold.

Again, the fixing of the first fastener 31 is realized by using a thin locking plate 5 that may be rotated within opening 24 of faceplate 22 to interlock into recesses 24' arranged at the sidewalls of the border area of opening 24.

Covering plate 25 will thus only be used to cover opening 24 and locking plate 5 and provides a smooth and continuous shape of the outside surface of the first fastener 31 at the place of the entry of tube 30.

A gasket 35 may be provided to seal the gap between receiver 23 and first fastener 31.

Figure 4:
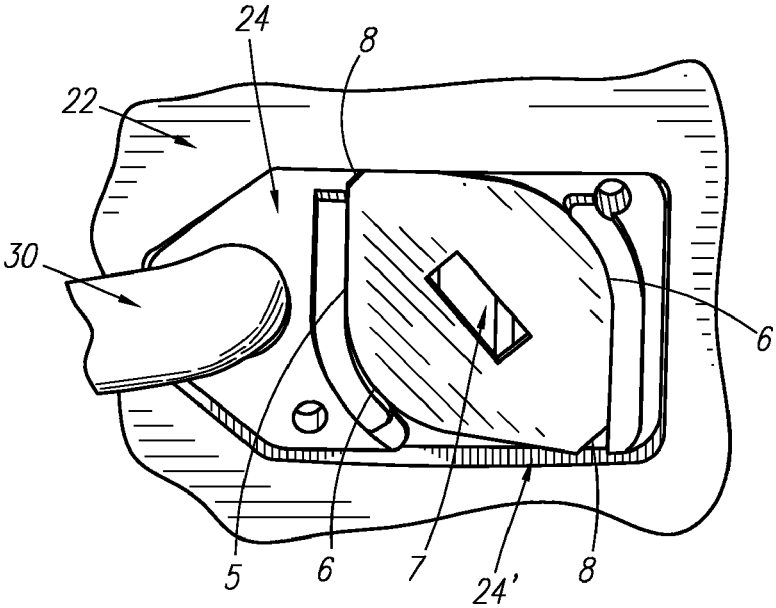
FIG. 4 is a partial view onto the backside of one embodiment of the ITE-part of a hearing device according to the present invention with a locking plate in its open position.

FIG. 4 depicts the front view into the opening 24 of faceplate 22 of an ITE-device 20 with the first fastener 31 already inserted. The back end of the first fastener 31 is positioned slightly below the outside edging of opening 24, with tube 30 protruding to the outside of faceplate 22. Locking plate 5 is applied into a recess 31' provided at the back end of first fastener 31.

Figure 5:
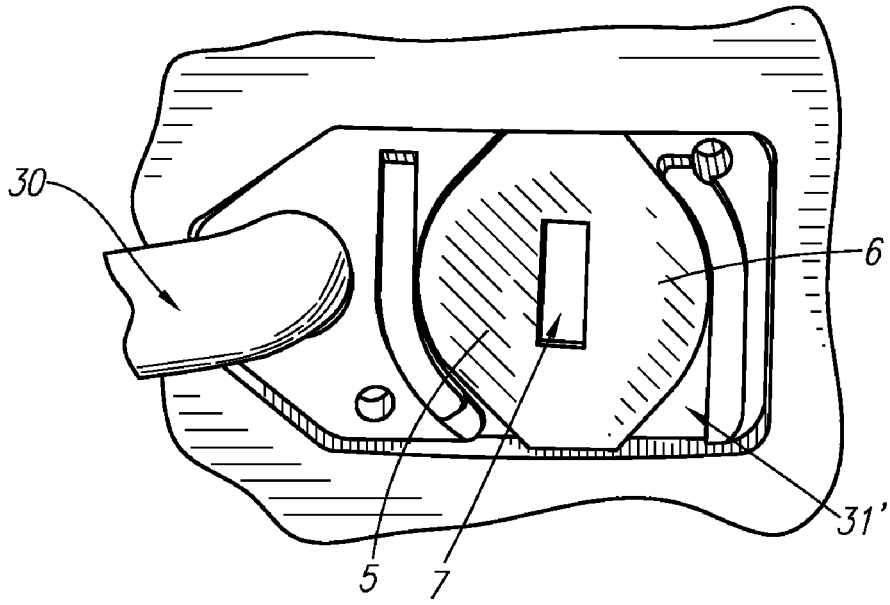
FIG. 5 is the same view as in FIG. 8 with the locking plate in its locked position.

The locking plate 5 has a rhombic shape with rounded edges 6 at least at the smaller diameter and has a rectangular opening 7 arranged in its center. Locking plate 5 may now be turned for example by using a screw-driver inserted into the rectangular opening 7 about 45°, thereby shifting its smaller edges 8 into grooves or recesses 24' arranged within the upper part of the sidewall of opening 24. The first fastener 31 is now detachably hold and fixed by locking plate 5 in its inserted state within faceplate 22, as shown in FIG. 5.

The recess 31' has a shape suitable to guide locking plate 5 during the turning of locking plate 5 from the open to the locked position by guiding the rounded edges 6. Thus, no vertical guide or pin is necessary for holding locking plate 5 in its working position. Thus, the locking mechanism only needs space in its insertion direction in the amount of the thickness of locking plate 5.

Figure 8:
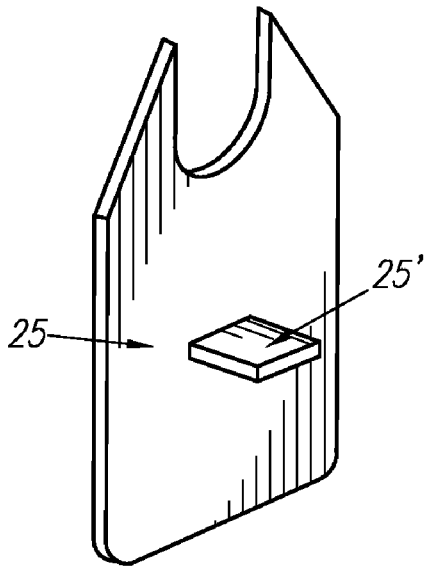
FIG. 8 is a view to the inner side of the covering plate shown in FIGS. 1 and 3.

Covering plate 25 may now be inserted above locking plate 5 to close opening 24 of faceplate 22. A rectangularly shaped nose 25' may be provided at the inner side of covering plate 25, adapted to be clamped into said rectangular opening 7 of locking plate 5, as shown in FIG. 8. By using this configuration, neither the backside of first fastener 31 nor locking plate 5 is visible from the outside of ITE-device 20.

Furthermore, the use of a flat locking plate 5 reduces the amount of space needed for attaching the first fastener 31 within the ITE-device 20 particularly with respect to the longitudinal dimension of ITE-device 20. It is thus possible to provide an ITE-device 20 with minimal longitudinal dimension that may fit even for extremely convoluted shaped ear canals. It is clear that any other suitable attaching means may be provided at covering plate 25 to attach covering plate 25 with faceplate 22.

Figure 6:
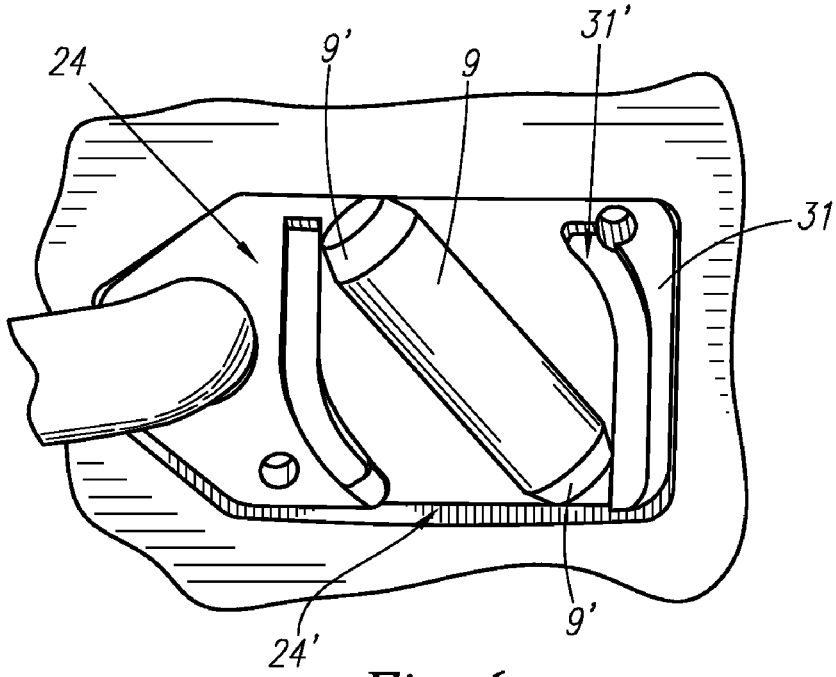
FIG. 6 is a partial view onto the backside of another embodiment of the ITE-part of a hearing device according to the present invention with a locking pin in its open position.
Figure 7:
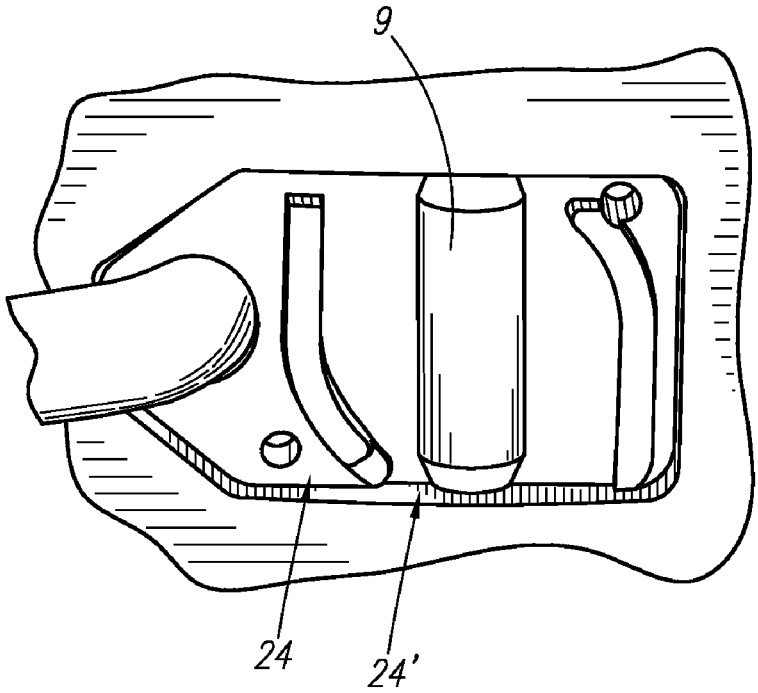
FIG. 7 is the same view as in FIG. 5 with the locking pin in its locked position.

Another embodiment of a locking device for locking the first fastener 31 within ITE-device 20 is shown in FIGS. 6 and 7. A locking pin 9 is used instead of a flat locking plate 5. This locking pin 9 has a generally cylindrical shape with truncated conically shaped ends 9'. It may be inserted in a crosswise position in relation to opening 24 into a circularly shaped recess 31' arranged at the backside of first fastener 31. By twisting locking pin 9 for instance clockwise around the longitudinal axis of ITE-device 20, its ends 9' may engage into respectively arranged grooves or recesses 24' arranged within the sidewall of opening 24. The first fastener 31 will thus be locked in its inserted position within ITE-device 20 and the opening 24 may be covered again by a covering plate 25 as already described.

By twisting locking pin 9 anti-clockwise, its ends 9' disengage from the recesses 24' and thus release the first fastener 31. Thereafter, locking pin 9 and first fastener 31 may be taken out from the opening 24.

It will be clear to one skilled in the art that other applications may be substituted for those set forth herein without departing from the spirit and scope of the present invention.

What is claimed is:

1. Hearing device with locking apparatus comprising:

a first component (10) with a housing (11) being adapted to be carried outside of or at the human body;

a second component (20) to be inserted either partially or fully into an ear canal of a human body; and a connecting means connecting mechanically said first component (10) and said second component (20), said connecting means comprising a tube (30) and a first fastener (31) being arranged at one end of said tube (30);

said first fastener (31), being adapted to detachably connect said second component (20) with said connecting means;

said hearing device further comprising an individual locking element (5;9) to be swiveled into retaining or locking surfaces arranged within said second component (20), thereby contacting outer surfaces of said first fastener (31) in its connected state with said second component (20).

2. Hearing device according to claim 1, further comprising an opening arranged at the second component (20) for receiving at least a part of said first fastener (31), wherein at least one recess (24') is arranged at the sidewall of said opening (24) providing said retaining or locking surfaces for said individual locking element.

3. Hearing device according to claim 2, further comprising two recesses (24') arranged at opposite sidewalls of said opening (24).

4. Hearing device according to claim 1 wherein said locking element is a thin locking plate (5), to be arranged transversally to the insertion direction of the first fastener (31) into said second component (20).

5. Hearing device according to claim 4 wherein said locking plate (5) has a rhombic shape and has an opening (7) arranged in its center.

6. Hearing device according to claim 5 wherein the locking plate (5) has rounded edges (6) at least at the smaller diameter of said locking plate (5).

7. Hearing device according to claim 5 wherein the opening (7) has a rectangular, triangular, square or hexagonal shape.

8. Hearing device according to claim 1 further comprising a second fastener (32) being arranged at the other end of said tube (30) and adapted to detachably connect said first component (10) with said connecting means.

9. Hearing device according to claim 1 wherein said tube (30) is a hollow tube with at least one end-to-end opened channel arranged within said tube (30).

10. Hearing device according to claim 1, further comprising electric wires (38) and a solid wire (39) provided within said tube (30), said solid wire (39) being firmly attached to said first fastener (31) thereby forming a pull-out safety device.

11. Hearing device according to claim 1 wherein electric wires (38) are arranged within the tube (30).

12. Hearing device according to claim 1 wherein said second component (20) is an ITE-device having a faceplate (22) and a shell (21) connected to said faceplate (22).

13. Hearing device according to claim 12 wherein an opening (24) is provided in said faceplate (22) for entering said first fastener (31) into said shell (21) of said ITE-device.

14. Hearing device according to claim 12 wherein a cavity (27) is provided at said faceplate (22) arranged at the inside of said shell (21), wherein said cavity is either made as a part of said faceplate (22) or as a separate part attached to said faceplate (22).

15. Hearing device according to claim 1 wherein said locking element is a pin (9) with a substantially cylindrically shape.

16. Hearing device according to claim 15 wherein the pin (9) has truncated conically shaped ends (9').

17. Hearing device according to claim 1 wherein a recess (31') is provided at the back end of said first fastener (31) to receive said locking element (5;9), having a shape that allows the locking element (5;9) to be turned or swiveled around an axis perpendicular in relation to the surface of the back end of said first fastener (31).

18. Hearing device according to claim 1 further comprising a covering plate (25) covering the back end of said first fastener (31) in its inserted state within said second component (20).

19. Hearing device according to claim 18 with tongues (25') arranged at the inner side of covering plate (25) to resiliently be plugged into respective receiving bores or openings arranged at the back end of said first fastener (31).

20. Method of detachably connecting a first component (10) and a second component (20) of a hearing device to each other by use of a connecting means, said hearing device comprising:

the first component being adapted to be carried outside of or at the human body; and the second component (20) being adapted to be inserted either partially or fully into an ear canal of a human body;

said connecting means connecting mechanically said first component (10) and said second component (20), said connecting means comprising a tube (30) and a first fasteners (31) being arranged at one end of said tube (30);

said method comprising the step of applying a detachable locking element (5;9) for locking said first fastener (31) in said second component (20);

said locking element (5;9) being inserted transversally to the insertion direction of the first fastener (31) into said second component (20) and being swiveled or turned around the insertion axis to engage into recesses (24') arranged in said second component (20) to fix said fastener (31) in its inserted state.

* * * * *